US006676895B2

(12) United States Patent
Kuhns

(10) Patent No.: US 6,676,895 B2
(45) **Date of Patent: *Jan. 13, 2004**

(54) METHOD OF MANUFACTURING AN OBJECT, SUCH AS A FORM TOOL FOR FORMING THREADED FASTENERS

(76) Inventor: Michael L. Kuhns, 200 N. Wheeling Rd., Prospect Heights, IL (US) 60070

( * ) Notice: Subject to any disclaimer, the term of this patent is extended or adjusted under 35 U.S.C. 154(b) by 0 days.

This patent is subject to a terminal disclaimer.

(21) Appl. No.: 10/074,159

(22) Filed: Feb. 12, 2002

(65) Prior Publication Data

US 2002/0131886 A1 Sep. 19, 2002

Related U.S. Application Data

(63) Continuation-in-part of application No. 09/588,935, filed on Jun. 5, 2000, now Pat. No. 6,537,487.

(51) Int. Cl.[7] ..... B22F 1/00
(52) U.S. Cl. ..... 419/36
(58) Field of Search ..... 419/36, 37

(56) References Cited

U.S. PATENT DOCUMENTS

| | | | | | |
|---|---|---|---|---|---|
| 3,882,210 | A | | 5/1975 | Crossley et al. | |
| 5,077,002 | A | | 12/1991 | Fried | |
| 5,252,119 | A | | 10/1993 | Nishida et al. | |
| 5,262,122 | A | * | 11/1993 | Wiech, Jr. | 419/36 |
| 5,308,556 | A | * | 5/1994 | Bagley | 264/13 |
| 5,314,658 | A | | 5/1994 | Meendering et al. | |
| 5,397,531 | A | | 3/1995 | Peiris et al. | |
| 5,482,671 | A | | 1/1996 | Weber | |
| 5,666,633 | A | | 9/1997 | Arnold et al. | |
| 5,737,683 | A | | 4/1998 | Sterzel | |
| 5,754,937 | A | | 5/1998 | Jones et al. | |
| 5,972,269 | A | | 10/1999 | Barros et al. | |
| 5,985,208 | A | | 11/1999 | Zedalis et al. | |
| 5,997,605 | A | * | 12/1999 | Carlbaum et al. | 75/246 |
| 6,224,816 | B1 | | 5/2001 | Hull et al. | |
| 6,350,407 | B1 | * | 2/2002 | Sakata et al. | 419/38 |
| 6,365,095 | B1 | * | 4/2002 | Bergkvist | 419/48 |
| 6,375,880 | B1 | * | 4/2002 | Cooper et al. | 264/138 |
| 6,444,167 | B1 | * | 9/2002 | Shimodaira et al. | 419/37 |
| 6,537,487 | B1 | * | 3/2003 | Kuhns | 419/29 |

* cited by examiner

*Primary Examiner*—Daniel J. Jenkins
(74) *Attorney, Agent, or Firm*—Wood, Phillips, Katz, Clark & Mortimer

(57) ABSTRACT

A method is provided for manufacturing an object, such as, for example, a form tool used for forming threaded fasteners. The method utilizes metal injection molding technology and processes to form densified parts having at least the near net shape of the desired object.

11 Claims, 3 Drawing Sheets

METHOD OF MANUFACTURING AN OBJECT, SUCH AS A FORM TOOL FOR FORMING THREADED FASTENERS

CROSS-REFERENCE TO RELATED APPLICATION

This application is a continuation-in-part of application Ser. No. 09/588,935, filing date Jun. 5, 2000 and titled: "METHOD OF MANUFACTURING FORM TOOLS FOR FORMING THREADED FASTENERS."now U.S. Pat. No. 6,537,487.

FIELD OF THE INVENTION

This invention relates to a metal injection molding method of manufacturing an object having a desired shape, such as a form tool for forming threaded fasteners.

BACKGROUND OF THE INVENTION

Form tools for forming threaded fasteners (hereinafter referred to as "threaded fastener form tools") are well-known in the threaded fastener industry. A few examples of the many known types of threaded fastener form tools are shown in FIGS. 1A–5. Specifically, FIGS. 1A–2B illustrate two punch-type threaded fastener form tools used for impact forming threaded fastener heads. More specifically, FIGS. 1A and 1B illustrate a threaded fastener form tool 10 for forming a flat head with a TORX type drive on a threaded fastener, while FIGS. 2A and 2B illustrate a threaded fastener form tool 12 used for forming a flat head with a PHILLIPS type drive on a threaded fastener. FIGS. 3A and 3B illustrate another form of punch-type threaded fastener form tool used to finish the head and TORX-type drive on a threaded fastener. While only three examples are illustrated, it will be appreciated that similar punch-type form tools can be used to form other types of threaded fastener heads, such as for example, round heads, fillister heads, oval heads, hexagon heads, and socket heads, as well as other types of drives, such as for example, hex socket, drilled spanner, fluted socket, slotted spanner, slotted, clutch, pozi drive, and one-way. FIGS. 4A and 4B illustrate a so-called "tri-lobular" form tool 14 and FIG. 5 illustrates a rolling thread type flat form tool 16 for forming the threads on a threaded fastener. While only two examples are illustrated, it will be appreciated that there are a number of other types of form tools used for forming the threads and shank of a threaded fastener.

Typically, threaded fastener form tools must produce a large number of threaded fasteners at a relatively high production rate to provide an economically feasible product. Additionally, the threaded fasteners are often formed from high strength materials and the features of the threaded fasteners must be held to relatively tight tolerances to provide the desired capabilities and quality for the threaded fasteners. Further, many of the threaded fasteners have relatively intricate, small scale features that must be mirrored on the threaded fastener form tools as shown by the examples in FIGS. 1A–2B. In view of these factors, threaded fastener form tools are typically made from materials having very high strength and hardness and must be manufactured with great precision in order to produce threaded fasteners having the desired features, capabilities and quality. Conventionally, such threaded fastener form tools are manufactured by highly skilled machinists using precision machining operations or from wrought metal material. While this method of manufacture produces acceptable threaded fastener form tools, it is relatively expensive and time-consuming.

SUMMARY OF THE INVENTION

It is a primary object the invention to provide a new and improved method of manufacturing an object having a desired shape, such as a threaded fastener form tool.

According to one embodiment of the invention, the method includes the steps of preparing a feedstock of powdered metal and binder; heating and injecting the feedstock into a mold having an over-sized, negative image of the threaded fastener form tool; hardening the feedstock in the mold to form a green part; removing the green part from the mold; reworking the green part to alter at least one of the shape and size of the green part; debinding the green part to form a debound part; and sintering the debound part to form a densified part having at least the near net shape of the threaded fastener form tool.

According to another embodiment of the invention, a method is provided for manufacturing an object having a desired shape. The method includes the steps of preparing a feed stock of powdered metal and binder; heating and injecting the feed stock into a mold having an over-sized, negative image of the object; hardening the feed stock in the mold to form a green part; removing the green part from the mold; placing the green part in inventory; removing the green part from inventory; and reworking the green part to modify at least one of the shape and size of the green part.

In accordance with one form of the invention, the method further includes the steps of heat treating and/or finish machining the threaded fastener form tool after the sintering step.

According to another embodiment of the invention, the method includes the steps of loading a powdered metal mixture into a compression mold having a negative image of the threaded fastener form tool; compressing the powdered metal mixture in the compression mold to form a green part having at least the near net shape of the threaded fastener form tool; removing the green part from the compression mold; and sintering the green part to form a densified part having at least the near net shape of the threaded fastener form tool.

Other objects and advantages will become apparent from the following specification taken in connection with the accompanying drawings.

DETAILED DESCRIPTION OF THE PREFERRED EMBODIMENTS

While the preferred embodiments of the invention are described herein primarily in connection with the manufacturing of threaded fastener form tools, it should be appreciated that the method may be used to manufacture other types of objects having a desired shape. Accordingly, no limitations to a specific object or to threaded fastener form tools are intended, unless expressly stated in the appended claims.

Figure 1A:
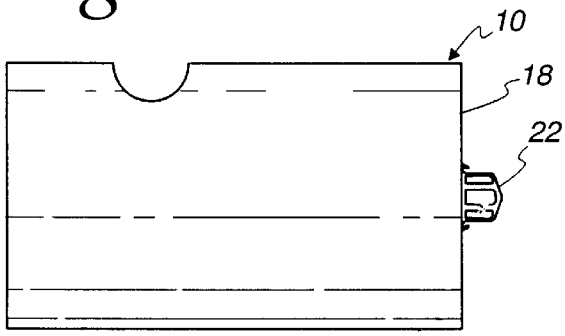
FIGS. 1A and 1B are a side and end view, respectively, showing one example of a threaded fastener form tool used for forming a threaded fastener.
Figure 1B:
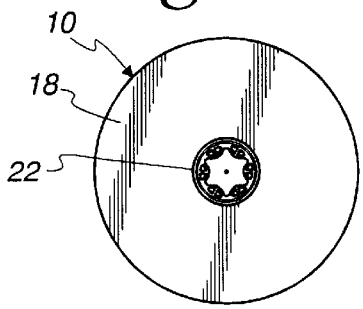
Figure 2A:
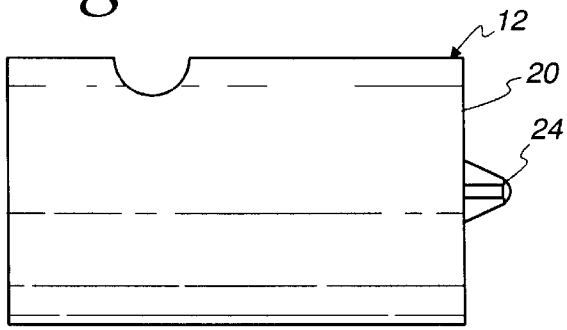
FIGS. 2A and 2B are a side view and an end view, respectively, of another example of a threaded fastener form tool.
Figure 2B:
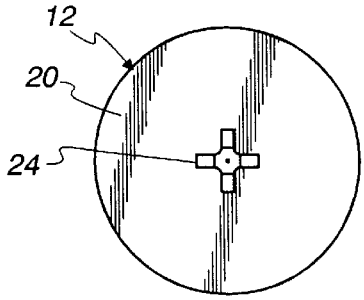
Figure 3A:
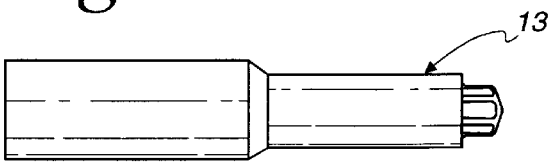
FIGS. 3A and 3B are a side view and an end view, respectively, of a further example of a threaded fastener form tool.
Figure 3B:
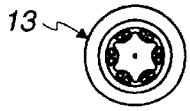
Figure 4A:
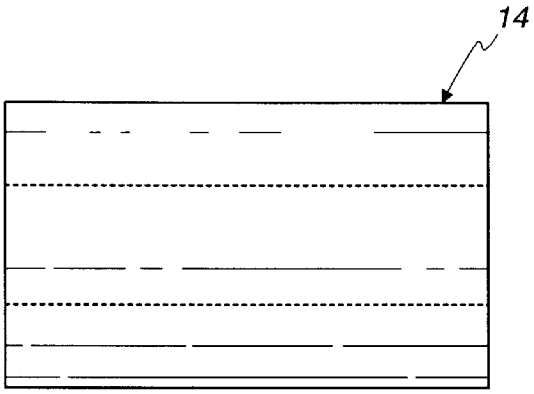
FIGS. 4A and 4B are a side view and an end view, respectively, of yet another example of a threaded fastener form tool.
Figure 4B:
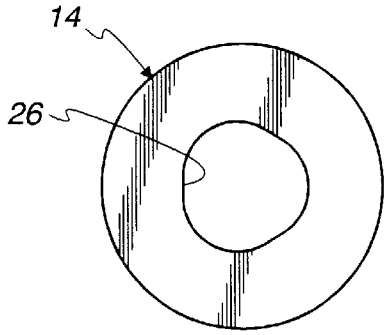
Figure 5:
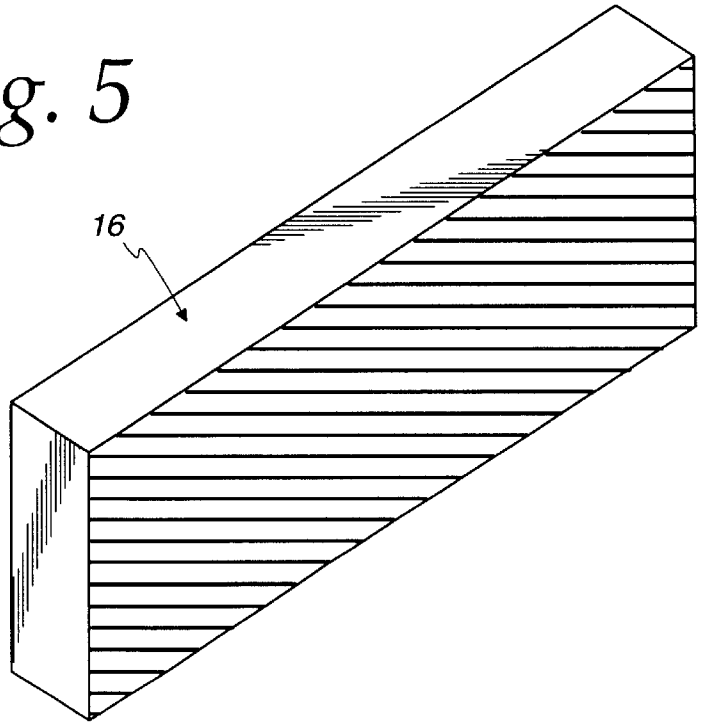
FIG. 5 is a perspective view showing yet another example of a threaded fastener form tool.
Figure 6:
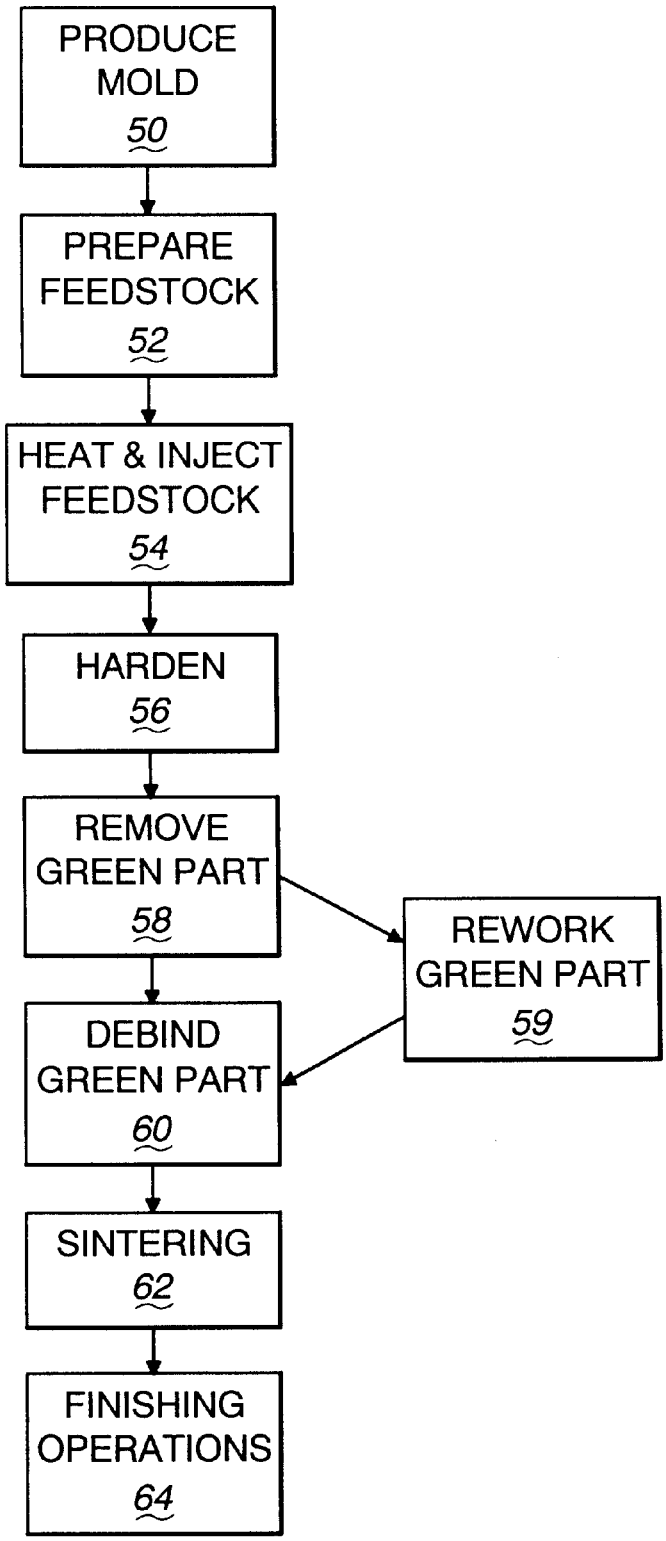
FIG. 6 is a flow diagram illustrating a method of manufacturing a threaded fastener form tool embodying the present invention.

While a few examples of the many known types of threaded fastener form tools have been described in the Background section and shown in FIGS. 1A–5, it should be appreciated that the preferred embodiments of the method for manufacturing a threaded fastener form tool described herein may be utilized for manufacturing any threaded fastener form tool. Accordingly, it should be understood that no limitation to use with a specific type of threaded fastener form tool is intended except in so far as expressly stated in the appended claims FIG. 6 depicts a method for manufacturing a threaded fastener form tool. The method utilizes metal injection molding (MIM) processes to manufacture the form tool. As shown at block 50, a mold is produced having an over-sized, negative image of a desired threaded fastener form tool, such as an over-sized negative image of any of the threaded fastener form tools described in the Background Section and/or shown in FIGS. 1A–5. As will be explained in more detail below, the negative image will typically be over-sized in the range of about 15% to about 22% greater than the net shape of the desired threaded fastener form tool to allow for shrinkage of the "green part" produced using the mold. The exact amount of over-sizing will be highly dependent upon the configuration of the desired threaded fastener form tool and the materials selected therefore. The mold is similar to the molds used in plastic injection molding and can include features, such as gates to ensure that the mold is completely filled. As is common in plastic injection molding, it is preferred that the mold be a modular type mold having a number of modular inserts that may be selectively used in the mold to produce different configurations of threaded fastener form tools. For example, a modular type die can be provided to form a variety of the punch-type threaded fastener form tools 10 and 12 shown in FIGS. 1A–B and 2A–B by providing a modular insert that would define the outside diameter or shape of the threaded fastener form tool and another modular insert that would define the respective end portions 18 and 20 and drive-forming features 22 and 24 of the threaded fastener form tools 10 and 12. By way of further example, a modular type mold could be provided for forming a variety of tri-lobular die tools 14, with a modular insert used to define the outside diameter of the die tool 14 and a modular core used to define the interior features 26 of the die tools 14.

As shown at block 52, a feedstock is prepared by blending powdered metal with a binder, which is typically a polymer. Other components, such as a dispersant, may also be blended into the feedstock. Typically, the powdered metal will be extremely fine (in the range of about 10 to about 20 microns). However, it is known to use particle sizes of less than 10 microns. Many suitable types of powdered metals, binders, and other additives are commercially available for use in preparing the feedstock. The preparation of this feedstock often includes plasticizing the components of the feedstock after they are blended and then granulating the plasticized feedstock after it is solidified. While it is possible to form a number of suitable materials using MIM processes, it is preferred that the threaded fastener form tools be made of tool steel or carbide, such as M-4 tool steel or D-70 carbide. The specific parameters for preparing feedstock, such as the components and their relative proportions, will be highly dependent upon the particular configuration of the desired threaded fastener form tool and the specific material and material properties desired for the threaded fastener form tool, and are within the abilities of one skilled in the art to select.

As shown at block 54, after it is prepared, the feedstock is injected into the mold using a suitable injection molding tool, a number of forms of which are well-known. During the injection process, the feedstock is heated to a flowable state that allows the feedstock to fill the negative image in the mold. As shown at blocks 56 and 58, after it is injected into the mold, the feedstock material hardens to a solid or gel-like state to form a "green part" that can be removed from the mold, with the part being substantially or completely self-supporting.

Optionally, as shown at block 59, secondary forming operations can be performed on the green part after it is removed from the mold. For example, the shape and/or size of the green part can be adjusted by material removal or pressure forming using standard techniques on the green part. As another example, a heated tool having a specific shape (such as a tread form, a cylinder, or the internal shape for a so called "tri-lobular" form tool) can be inserted into the green part to form an opening having a specific internal shape in the green part by melting the blended powder metal and binder as the tool is inserted into the green part. In one example, the melting temperature of the binding material is approximately 375° F., and the tool can be heated to 400° F. and inserted into the green part to form the desired internal shape. Preferably the heated tool is inserted into the green part and then allowed to cool so that the binder hardens around the tool to form the desired shape. After cooling, the tool is backed out of the green part. In this regard, it is preferred that the tool be coated with a mold release compound, such as a copper sulfate paste coating. One advantage of being able to perform secondary forming operations on the green part is that it allows a producer to maintain an inventory of green parts having the near net shape of a desired fastener form a tool or other product, but whose shape can be altered to fulfill specific orders for a specific type of part. For example, this would allow a producer, such as a fastener form tool producer, to offer a particular part with a variety of different internal shapes, such as for example, different drive shapes for a fastener form tool, and then to provide the part from the inventory of green parts by pulling the green parts from inventory and selectively altering the shape and/or size of the green parts to meet specific orders or request.

Next, as shown at block 60, the green part undergoes a debind operation wherein most or all of the binder is removed from the green part using heat and/or solvent depending upon the type of binder used. Because of the removal of binder, the debound parts are relatively porous, but will typically be approximately the same size as the green part. If heating is used, it will typically be done using a controlled atmosphere furnace. The specific parameters used during the debind operation, such as atmosphere, pressure, type of solvents, temperatures, and time at temperatures, will be highly dependent upon the particular application, and are within the abilities of one skilled in the art to select. For example, the temperature of the heating and/or the composition of the solvent will be dependent upon the materials used in the feedstock and, in particular, the type of binder used in the feedstock.

The debind operation produces a so-called "brown" or "debound" part which can then be sintered at an elevated temperature typically above 2,200° Fahrenheit but below the melting point of the material in the debound part, as shown at block 62. The sintering operation will typically take place in a controlled atmosphere furnace, and will typically remove any binder that remains in the debound part. Depending upon the particular material selection for the threaded fastener form tool and the desired final properties of the material, isostatic pressing may be employed during the sintering process, as is known. During the sintering operation, the surface energy between the metal particles in the debound part is released and the metal particles are fused together thereby densifying and shrinking the debound part into a densified part, which is either the near net shape or the net shape of the desired threaded fastener form tool. As discussed above in connection with the over-sized image in the mold, the shrinkage of the debound part to the densified part can be in the range of about 15% to about 22%. The specific parameters of the sintering operation, such as the temperatures, time at temperatures, atmosphere, and pressure, will be highly dependent upon the configuration of the threaded fastener form tool being manufactured, and the material and the final material properties desired for the threaded fastener form tool, and are within the capabilities of one skilled in the art to select.

Optionally, if required after the sintering operation, a number of finishing operations may be performed on the densified part, as shown at block 64. For example, after the sintering operation, the densified part may undergo heat treating, such as quench and temper, austempering, induction hardening, or case hardening, to provide a desired tensile strength and hardness for the threaded fastener form tool. Again, the particular type of hardening and the parameters thereof will be highly dependent upon the configuration of the desired threaded fastener form tool and the desired material and material properties of the threaded fastener form tool, and are within the capabilities of one skilled in the art to select.

By way of further example, as required after a sintering operation, or after the hardening operation if one is employed, the densified part may be finish machined to achieve the dimensional tolerances desired for the threaded fastener form tool.

Because the densified parts are the near net shape or the net shape of the desired threaded fastener form tool, the above described methods can significantly reduce the amount of expensive machining required to produce threaded fastener form tools having the desired tolerances, features, and material properties. Thus, the above-described methods can produce threaded fastener form tools in a more timely fashion and at less expense than may be provided using conventional methods of manufacture. Further, the consistency of the threaded fastener form tools produced using the same mold may be improved over the consistency of threaded fastener form tools manufactured using conventional machining techniques.

What is claimed is:

1. A method of manufacturing a threaded fastener form tool, the method comprising the steps of:

preparing a feedstock of powdered metal and binder;

heating and injecting the feedstock into a mold having an over-sized, negative image of the threaded fastener form tool;

hardening the feedstock in the mold to form a green part;

removing the green part from the mold;

reworking the green part to alter at least one of the shape and size of the green part;

debinding the green part to form a debound part; and sintering the debound part to form a densified part having at least the near net shape of the threaded fastener form tool.

2. The method of claim 1 further comprising the step of heat treating the densified part.

3. The method of claim 2 wherein the heat treating step comprises austempering the densified part.

4. The method of claim 2 wherein the heat treating step comprises induction hardening the densified part.

5. The method of claim 2 wherein the heat treating step comprises case hardening the densified part.

6. The method of claim 2 further comprising the step of finish machining the densified part after the heat treating step.

7. The method of claim 1 wherein the step of reworking the green part comprises inserting a heated tool into the green part to form a desired internal shape in the green part.

8. The method of claim 1 wherein the step of reworking the green part comprises inserting a heated tool into the green part at a temperature sufficient to cause the material of the green part to flow around the tool;

allowing the green part and the tool to cool to a temperature sufficient for the material of the green part to harden around the tool; and withdrawing the tool from the green part.

9. A method of manufacturing an object having a desired shape, the method comprising the steps of:

preparing a feedstock of powdered metal and binder;

heating and injecting the feedstock into the mold having an over-sized, negative image of the object;

hardening the feedstock in the mold to form a green part;

removing the green part from the mold;

reworking the green part to alter at least one of the size and shape of the green part by inserting a heated tool into the green part to form a desired internal shape in the green part;

debinding the green part to form a debound part; and sintering the debound part to form a densified part having at least the near net shape of the object.

10. A method of manufacturing an object having a desired shape, the method comprising the steps of;

preparing a feedstock of powdered metal and binder;

heating and injecting the feedstock into a mold having an over-sized, negative image of the object;

hardening the feedstock in the mold to form a green part;

removing the green part from the mold;

placing the green part in inventory;

removing the green part from inventory; and reworking the green part to modify at least one of the size and shape of the green part by inserting a heated tool into the green part to form a desired internal shape in the green part.

11. The method of claim 9 wherein the step of reworking further comprises allowing the heated tool to cool so that the feedstock hardens around the tool to form the desired internal shape.

* * * * *